United States Patent [19]

Brochman

[11] 4,215,791

[45] Aug. 5, 1980

[54] EASY OPEN CLOSURE SYSTEM

[75] Inventor: Wilfred R. Brochman, Oakdale, Minn.

[73] Assignee: Minnesota Mining and Manufacturing Company, Saint Paul, Minn.

[21] Appl. No.: 63,756

[22] Filed: Aug. 6, 1979

[51] Int. Cl.[2] ..... B65D 51/22

[52] U.S. Cl. ..... 220/258; 220/260; 220/269; 220/271; 220/359

[58] Field of Search ..... 222/258, 260, 265-271, 222/359; 229/7 R; 222/541

[56] References Cited

U.S. PATENT DOCUMENTS

| | | | |
|---|---|---|---|
| 3,339,788 | 9/1967 | Lipske | 220/270 |
| 3,371,818 | 3/1968 | Bozek | 220/267 |
| 3,441,167 | 4/1969 | Balocca et al. | 220/271 |
| 3,804,287 | 4/1974 | Balocca et al. | 220/260 |
| 3,990,603 | 11/1976 | Brochman | 220/260 |
| 4,108,330 | 8/1978 | Patterson | 220/260 |
| 4,135,637 | 1/1979 | Hannula | 220/271 |

*Primary Examiner*—George T. Hall

*Attorney, Agent, or Firm*—Cruzan Alexander; Donald M. Sell; Dean P. Edmundson

[57] ABSTRACT

An improved easy open closure system is described which comprises an interior sheet material and an exterior flexible film. The exterior flexible film is essentially free of adhesive and is secured to the interior sheet material in the area of the opening by means of the adhesive layer of the interior sheet material.

14 Claims, 8 Drawing Figures

EASY OPEN CLOSURE SYSTEM

BACKGROUND OF THE INVENTION

This invention relates to containers having a preformed opening or pour hole therein covered by a removable (i.e., hand peelable) closure system. More particularly, the present invention relates to a closure system wherein an exterior flexible film and an interior sheet material are used to seal a container.

Previously described two-tape closure systems, e.g., U.S. Pat. Nos. 2,870,935 (Houghtelling), 3,292,828 (Stuart), 3,339,788 (Lipski), 3,990,603 (Brochman), 4,108,330 (Patterson) and 4,135,637 (Hannula), employ two or more tapes or sheet material wherein an exterior tape is adhered to the outer surface of a container end portion as well as to an interior sheet material. When using closure systems of this type, however, adhesive residue from the exterior tape sometimes remains on the container end portion upon opening, thereby rendering the container commercially less acceptable. Furthermore, the exterior tape may have a tendency to gradually detach (that is, creep) from the container end when exposed to high storage temperatures (i.e., 100° F.), depending upon the adhesive used on the exterior tape. This results in an undesirable appearance and can even eventually result in failure of the closure system. Also, when an exterior tape is used in the closure system, the type of enamel coating present on the container end will affect the level of adhesion of the exterior tape to the container end.

U.S. Pat. Nos. 3,583,595 (Eike) and 3,441,167 and 3,804,287 (both to Balocca) describe resealable closure systems employing a rigid plastic plug which is bonded to the container end by means of an interior tape and which is further held in place due to tight engagement of the plug with the container end. Such closure systems are expensive to make and require specialized machinery both in the fabrication of the plugs and in the assembly of the closure systems themselves. U.S. Pat. No. 3,371,818 (Bozek) describes a closure system comprising a nonflexible, nonconformable plastic tab which also is bonded to the container end by means of an interior tape and which is fashioned with a cutter to facilitate tearing of the interior tape upon opening.

SUMMARY OF THE INVENTION

In accordance with the present invention there is provided an end portion for a container, said end portion having a preformed opening and an easy open closure system comprising:

a. an interior sheet material which covers the underside of said opening and which is firmly adhered to the bottom of said end portion circumjacent said opening, said interior sheet comprising
   i. a backing member of about 15 to 100 micrometers in thickness and a ppt value in the range of about 15 to 200 grams/ply;
   ii. a layer of adhesive, having a thickness of about 3 to 100 micrometers, firmly adhering said backing member to said end portion;

b. an exterior flexible film circumjacent said opening, said flexible film at least 6.3 mm in width and about 25–250 micrometers in thickness which neither breaks nor elongates more than 25% under a tension of 4 pounds (1.8 kg) and which is capable of being pulled back upon itself without rupturing, and wherein said flexible film is essentially free of adhesive and is bonded to said interior sheet material in the area of said opening by means of said layer of adhesive of said interior sheet material;

wherein said means of adhesive attachment will withstand a force of up to 22 pounds per inch width (3.9 kg per cm width) of said exterior flexible film at temperatures from at least 35° F. to 100° F. (2° to 38° C.) without separation of said flexible film from said interior sheet material, and wherein at least one of said flexible film and said interior sheet material is moisture impervious.

The invention provides a commercially desirable closure for use with still beverages packed under atmospheric or sub-atmospheric pressures, low pressure noncarbonated beverages, and carbonated beverages, which avoids the possibility of adhesive residue remaining on the container end after opening and the undesirable appearance which can result from creep of an exterior tape. Also, since the exterior flexible film is not adhesively attached to the top of the container end itself in the area circumjacent the preformed opening (but rather is attached only to the interior sheet material), a closure system is provided which requires lower opening force and which is independent of the type of enamel coatings used on the container end. Unlike most examples known in the art, the closure system of the present invention will withstand the pressures encountered when packaging hot still beverages, thereby avoiding the need for an additional steam closure process requiring specialized equipment not normally available. The fact that the closure system of this invention is very economical will allow the use of more expensive aluminum container ends for packaging beverages.

DETAILED DESCRIPTION OF THE INVENTION

The invention is described in more detail hereinafter with reference to the accompanying drawings wherein like reference characters refer to the same parts throughout the several views and in which.

Figure 1:
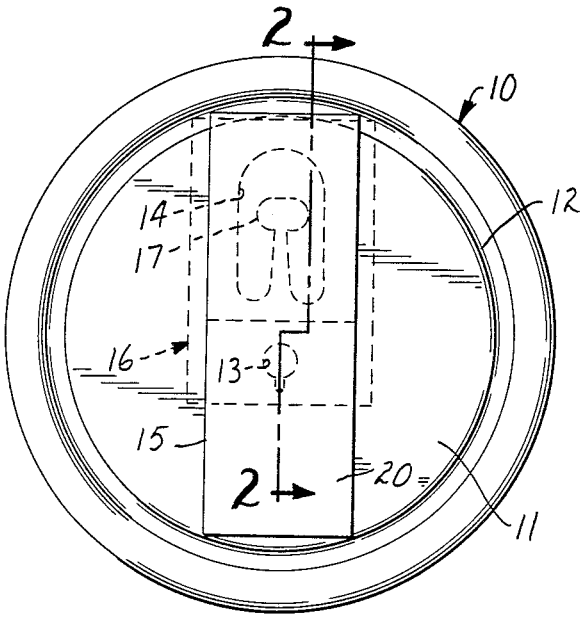
FIG. 1 is a top view of one embodiment of the present invention applied to a container-end portion.

Thus, in FIG. 1 there is shown a container end portion 10 (such as might be seamed onto a cylindrical, metal container body) comprising a generally circular, flat, rigid disc or lid 11 defined by edge 12, the end portion having therein a vent opening 13 (shown in phantom), and elongated preformed opening or pour hole 14 (shown in phantom). Such an end portion might be produced in large numbers as in a stamping operation. The rectangular exterior flexible film 15 is shown covering the pour hole 14 and vent hole 13. The interior sheet material 16, which is attached to the underside of the container end portion, is shown in phantom.

After opening a container having a film-tape, easy open closure system, it is commercially expedient to have some means of directing the exposed film and tape portions away from the pour hole 14 so as not to interfere in the pouring operation. In the embodiment of FIG. 1, the means of directing the removed film and tape away from the pour hole is a tongue or T-tab 17 (shown in phantom in FIG. 1), which is described in U.S. Pat. No. 4,108,330 (Patterson), incorporated herein by reference. In addition to directing the removed film and tape portions away from the pour hole 14, the tongue 17, in conjunction with the interior sheet material 16 and the exterior flexible film 15 (which together effectively cover the tongue, reducing exposure of the container contents to bare metal) prevents total separation of the closure system from can end at removing forces less than 25 pounds. Thus, for convenience and environmental reasons, a means for retaining the exposed film and tape portions away from the pour hole such as the T-tab 17, is preferred.

Figure 2:
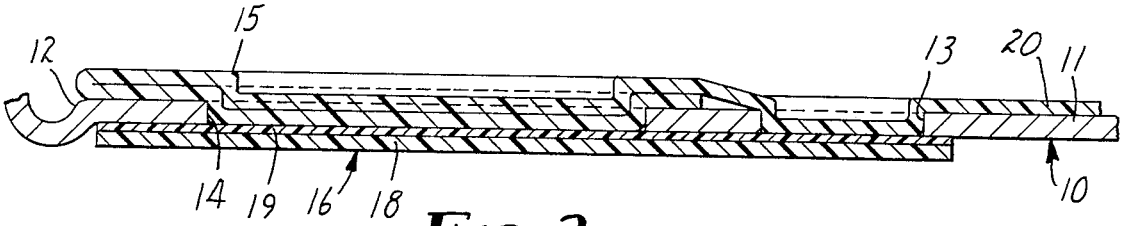
FIG. 2 is a section view taken along line 2—2 of FIG. 1 showing the closure system prior to venting or opening.

FIG. 2 illustrates the folding of the exterior flexible film 15 near the edge 12 of the end portion disc such that the portion of the flexible film which overlays the portion of the flexible film circumjacent the pour hole 14 is circumjacent the vent hole 13. Interior sheet material 16 comprises backing member 18 which is firmly adhered to the underside of end portion 10, circumjacent pour hole 14 and vent hole 13, by means of adhesive layer 19. Clearly illustrated is the conformability of the exterior flexible film 15 to the pour hole 14 and vent hole 13 cavities such that the flexible film is adhesively attached to the interior sheet material 16 in the area of the pour hole 14 and the vent hole 13 solely by means of the adhesive layer 19 of the interior sheet material 16. Also shown is the grip portion 20 of the exterior flexible film 15.

Figure 3:
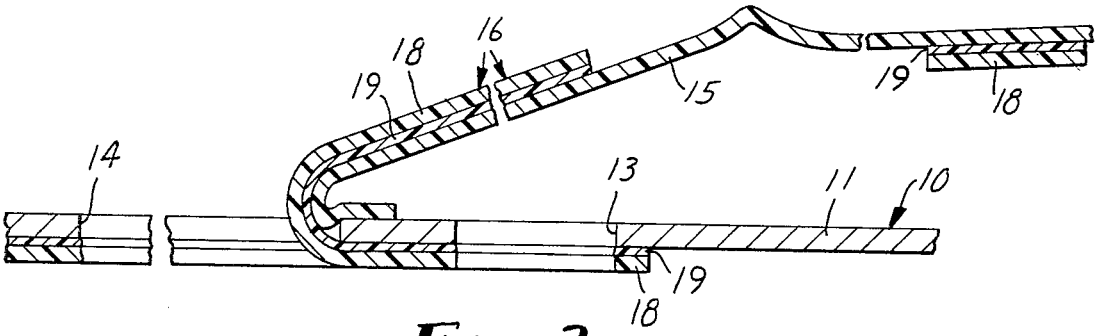
FIG. 3 is a section view similar to FIG. 2 after both venting and opening of the container end pour hole has occurred.

In FIG. 3 venting and opening of the container has occurred. T-tab (not shown in FIG. 3) directs the removed film and tape portions away from the pour hole.

The operation of the closure system depicted in FIGS. 1, 2 and 3 may be visualized by examination of the illustrations. The consumer encounters the top of a beverage container as depicted in FIG. 1. Placing a finger adjacent to the grip portion 20 of the exterior flexible film 15 and pulling in any direction away from the container end 10, vents the container to ambient pressure. Continued application of removing force to the grip portion reverses the peel direction and begins to peel the exterior flexible film 15 from adjacent the edge 12 of container end. As the exterior flexible film 15 is removed from the container end 10, the interior sheet material 16 is torn and pulled through the pour hole 14 and access to the container contents is gained. Complete opening of the container is depicted in FIG. 3, wherein flexible film 15 and a segment of interior sheet material 16 are shown folded away from the pour hole 14. T-tab 17 (not shown in FIG. 3) secures the closure system to the container end 10 and directs the fully opened closure system away from the pour hole 14.

Figure 4:
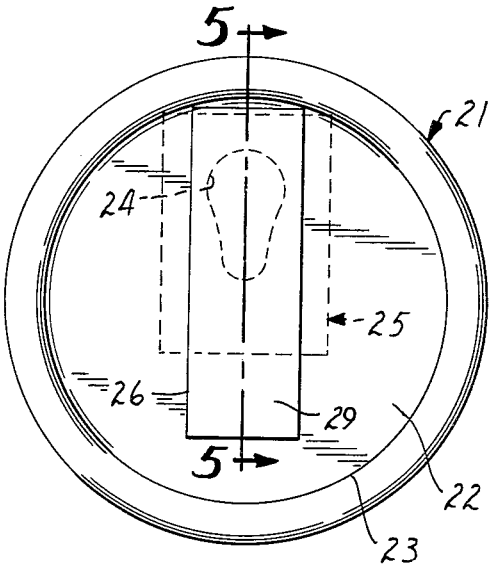
FIG. 4 is a top view of another embodiment of the present invention applied to a container-end portion.

FIG. 4 illustrates a container end 21 comprising a generally circular flat, rigid disc or lid 22 defined by edge 23, the end portion having a closure system which may be used for packaging still beverages. Preformed opening or pour hole 24 (shown in phantom) is depicted in the preferred embodiment for this type of container end and is sealed using an interior sheet material 25 (shown in phantom) and exterior flexible film 26 similar to that illustrated in FIGS. 1, 2 and 3. This embodiment may employ a pressure-relief opening such as is described in U.S. Pat. No. 3,990,603 (Brochman), incorporated herein by reference, in association with the preformed opening. This embodiment may also employ a T-tab (not illustrated in FIG. 4) when the exterior flexible film is folded in a manner analogous to that illustrated in FIGS. 1, 2 and 3, in order to prevent total separation of the closure system from the container end.

Figure 5:
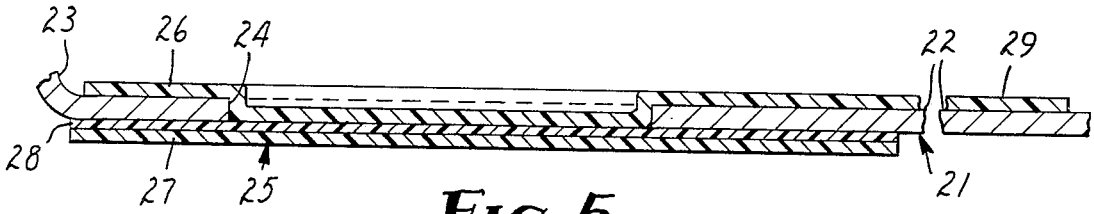
FIG. 5 is a section view taken along line 5—5 of FIG. 4 showing the closure system prior to venting or opening.

FIG. 5 illustrates the conformability of the exterior flexible film 26 to the pour hole cavity 24 such that the flexible film 26 is adhesively attached to the interior sheet material 25, which comprises backing member 27 and adhesive layer 28, in the area of the pour hole 24 solely by means of the adhesive layer 28 of the interior sheet material 25.

The operation of the closure system depicted in FIGS. 4 and 5 consists of placing a finger adjacent the grip portion 29 (shown in FIG. 5) of the exterior flexible film 26 and pulling away from the container end portion towards the edge of the end portion.

Figure 6:
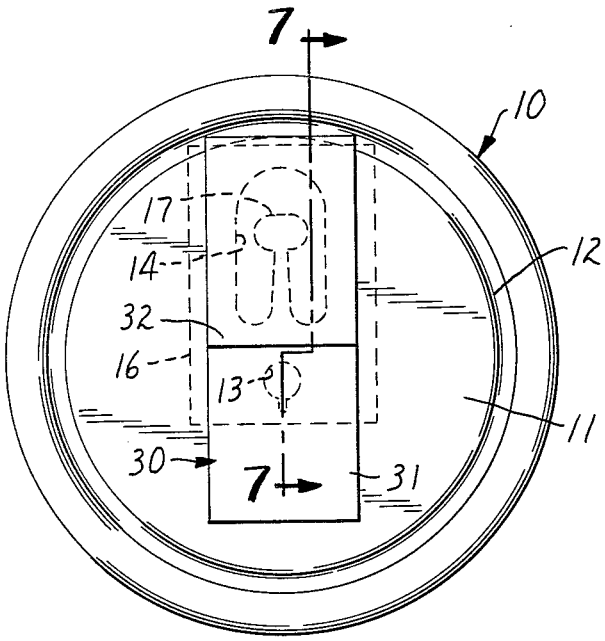
FIG. 6 is a top view of another embodiment of the present invention applied to a container-end portion.
Figure 7:
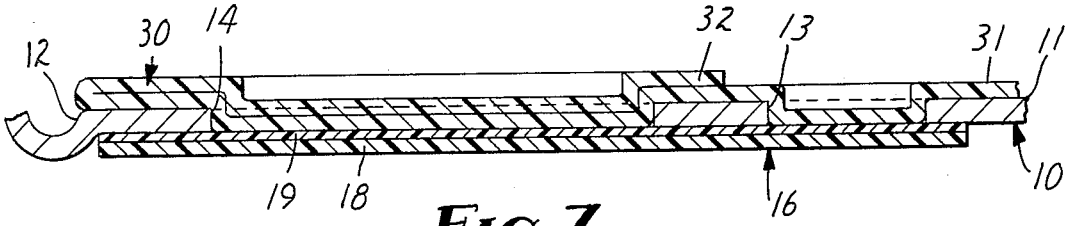
FIG. 7 is a section view taken along line 7—7 of FIG. 6 showing the closure system prior to venting or opening.
Figure 8:
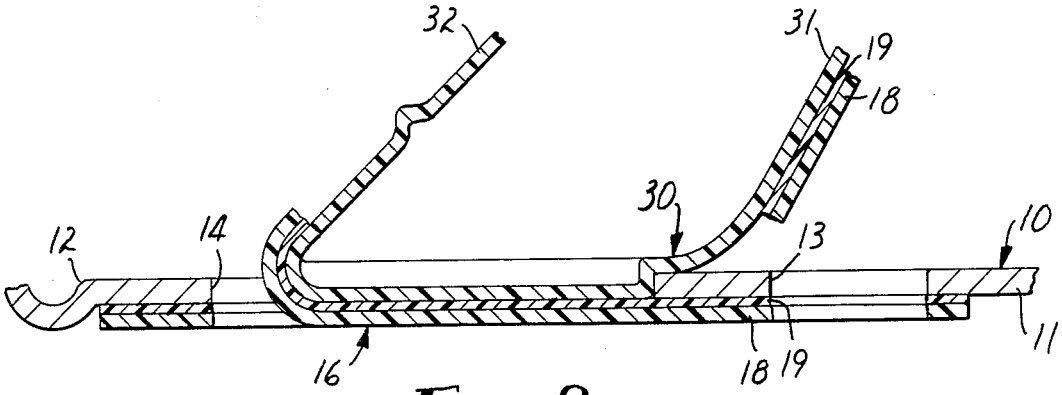
FIG. 8 is a sectional view similar to FIG. 7 after both venting and opening of the container pour hole has occurred.

FIGS. 6, 7 and 8 illustrate an embodiment of the invention similar to that shown in FIGS. 1, 2 and 3 except for the folding of the exterior flexible film 30. Here (in contrast to FIGS. 1, 2, and 3) the portion of the flexible film 30 which overlays the portion of the film circumjacent the pour hole 14 is not circumjacent the vent hole 13. The advantage of this embodiment is that a shorter length of exterior flexible film is exposed upon opening the container.

The operation of the closure system depicted in FIGS. 6, 7 and 8 consists of placing a finger adjacent the grip portion 31 (illustrated in FIG. 7) of exterior flexible film 30 and pulling away from the container-end portion 10 in order to vent the container to ambient pressure. One then places a finger adjacent grip portion 32 (illustrated in FIG. 7) of the exterior flexible film 30 and pulls away from the container end. Continued application of removing force reverses the peel direction and peels the exterior flexible film 30 from adjacent the edge 12 of container end. As the exterior flexible film 30 is removed from the container end 10, the interior sheet material 16 is torn and pulled through the pour hole 14 and access to the container contents is gained.

The characteristics of the exterior flexible film are critical to proper operation of the closure system of the invention. The flexible film must possess the characteristic that it conforms to the dimensions of the pour hole cavity while also being of sufficient internal strength to allow it to remove the interior sheet material in the area of the pour hole. Conformability of the film to the pour hole cavity assures clean pull-out of the interior sheet material in the area of the pour hole and the vent hole. Thus, unoriented films or films having little uniaxial or biaxial orientation are preferred in this invention since highly oriented films are usually rigid and do not easily conform to the dimensions of the pour hole cavity.

The exterior flexible film should be 25–250 micrometers in thickness and should neither break nor elongate more than 25% under a tension of 4 pounds (1.8 kg). At the preferred width of ¾ inch (1.9 cm), the film should have a strength at break of at least 4 pounds (1.8 kg) in order to withstand the forces exerted on it with an adequate margin of safety.

The exterior flexible film is essentially free of adhesive, i.e. such film has no adhesive attachment to the container end portion in the area circumjacent the preformed opening(s) and therefore does not contribute to the containment of pressure (which can range from about 0.25 to 6 atmospheres) in the container. Absence of adhesive in the area circumjacent the preformed opening(s) is desired in order to avoid the problems associated with adhesive splitting and creep as has already been discussed. However, as an alternative to the preferred T-tab already discussed, a small portion or area of the exterior flexible film may be adhesively secured to the container end in a manner so as to prevent complete detachment of the closure system from the container end portion if this is desired. Means for such an adhesive attachment includes employment of a narrow band or pattern of adhesive on the terminal end of the exterior flexible film in a manner analogous to that described in U.S. Pat. No. 3,990,603 (Brochman), incorporated herein by reference, for an exterior tape. This adhesive attachment, however, does not contribute to the sealing of the container itself, i.e. the pressure in the container is contained solely by means of the interior sheet material.

Representative materials which have been found to be suitable as unoriented or flexible films of low orientation include polypropylene, polytetramethylene terephthalate (e.g. that available under the trade designation Tenite 6P4D from Eastman Chemical Products, Inc.), polyamide derived from 6-6 nylon (e.g., that available under the trade designation "Zytel ST 801 HS" from E. I. duPont deNemours Co.), physical blends of polytetramethylene terephthalate/polyethylene, physical blends of polytetramethylene terephthalate/phenoxy, glycol modified polyethyleneterephthalate (e.g. that available under the trade designation "Kodar 6763" from Eastman Chemical Products, Inc.), unplasticized polyvinylchloride, polyethyleneterephthalate/polyethylene composites (e.g. that available under the trade designation of "Scotchpac" from 3M Co.), and films derived from a graft copolymer comprising acrylonitrile/methylmethacrylate copolymer grafted onto an acrylonitrile/butadiene copolymer backbone (e.g. that available under the trade designation "Barex" from Vistron Corporation). Other representative materials include dead-soft aluminum and aluminum foil composites.

Those flexible films which are plastic may be vapor coated with a thin layer of metal (e.g. aluminum, silver, iron, etc.) to produce opacity and to improve the impermeability of the backing. Alternatively, pigment may be coated onto the film or may be added during the extrusion of the film itself.

In order to assure that the exterior flexible film adheres firmly to the adhesive layer of the interior sheet material in the area of the pour hole, it is often desirable to coat the exterior film with a primer at least in the area of the pour hole.

Useful primers are described in U.S. Pat. No. 3,990,603 (Brochman), incorporated herein by reference, and include polycarbodiimide polymers, a polyurethane (comprising the reaction product of 11.4 parts polyester diol, eq. wt. 8,000 and 1.1 parts polymethylenepolyphenylisocyanate, eq. wt. 132), and phenoxy resin (comprising thermoplastic condensation product of bisphenol A and epichlorohydrin, molecular weight about 30,000, with no terminal epoxy groups, commercially available from Union Carbide under the trade designation "Phenoxy PKHH").

In addition to priming the exterior flexible film, it is sometimes desirable to corona treat the film prior to application of the primer.

Parameters for the interior sheet material are described in U.S. Pat. No. 3,990,603 (Brochman), incorporated herein by reference. The interior sheet material must have the properties of resisting tear and rupture when the container is filled and yet which permit easy and clean tearing around the periphery of the pour hole when tear is initiated by removal of the exterior flexible film. Strength of the interior sheet material is particularly critical when the container is filled with a carbonated beverage. Here the interior sheet material must withstand the entire gas pressure exerted by the carbonated beverage since the exterior flexible film is not adhesively attached to the outside of the container end portion in any way which would assist in containing the pressure.

In order for the interior sheet material to perform in the desired manner it has been found that the backing member and adhesive must have proper balance of several characteristics. The backing member has a thickness of about 15 to 100 micrometers and must have a ppt value in the range of about 15 to 200 grams/ply. The ppt value is a measure of the force required to initiate a tear and to propagate such tear, and it is measured according to ASTM D-2582-67 (Reapproved 1970). When the ppt value is below 15 grams/ply, the backing member is generally too weak and fragile to withstand normal processing and handling in the manufacture of a film and in the fabrication of a closure. When the ppt value is greater than 200 grams/ply, the backing member is generally too tough and initiation of tear is extremely difficult.

The materials which have been found suitable as backing members for the interior sheet material include plastic films such as polyethyleneterephthalate, polyvinylchloride (unplasticized), composite films comprising a layer of polyethyleneterephthalate and a layer of polyethyleneterephthalate/polyethyleneisophthalate copolymer (with respective monomer ratios ranging from 60/40 to 80/20), and films derived from a graft copolymer comprising acrylonitrile/methylmethacrylate copolymer grafted onto an acrylonitrile/butadiene copolymer backbone. A particularly useful graft copolymer is formed by graft polymerizing acrylonitrile (73–77 parts by wt.) and methylmethacrylate (23–27 parts by wt.) in the presence of 8 to 10 parts by wt.) of an acrylonitrile/butadiene copolymer (70% by wt. derived from butadiene).

The adhesive layer comprising the interior sheet material is preferably less than about 100 micrometers in thickness and is firmly anchored to the backing member. The adhesive must provide a bond of sufficient strength between the exterior flexible film and interior sheet material such that when the exterior flexible film is stripped back, the interior sheet material is cleanly removed in the area of the pour hole. Suitable adhesives provide a means of attachment of the exterior flexible film to the interior sheet material which will withstand a force of up to 22 pounds per inch width (3.9 kg per cm width) of said exterior flexible film at temperatures from at least 35° F. to 100° F. (2° to 38° C.) without separation of the flexible film from the interior sheet material.

The specific adhesives which have been found to work include thermoplastic copolyester elastomers. These include segmented polyether esters which are high molecular weight condensation polymers derived from aromatic dicarboxylic acids, polyalkylene ether glycols, and short chain diols. The dicarboxylic acids may be, if desired, blends of acids such as terephthalic acid, isophthalic acid, etc. The polyalkylene ether glycol is a material such as polytetramethylene ether glycol (e.g. 2,000 mol wt). An example of a short chain diol is 1,4-butanediol. Adhesives of the foregoing type are described in U.S. Pat. No. 3,651,014, incorporated herein by reference. Particularly useful adhesives of this type include "Dyvax PB722" and "Dyvax PB5050" (both available from E. I. duPont de Nemours Co.).

These thermoplastic copolyester elastomers may be modified, if desired, by the addition thereto of tackifying resins such as coumarone-indene, hydrogenated rosin esters and terpene/urethane resins. Commercially available resins include "Cumar LX509" (available from Neville Chemical Co.) "Foral 105" (available from Hercules Chemical) and "Isoterp 95" (available from Schenectady Chemical Co.). Tackifying resins, when used, are typically present in an amount of about 5 to 25% by weight of the adhesive.

In one embodiment, the interior sheet material comprises a composite plastic film in which one layer thereof serves as the backing member and the other layer thereof serves as the adhesive. This particular composite film comprises a layer of polyethyleneterephthalate (which serves as the backing member) and a layer of polyethyleneterephthalate terephthalate (50-90)/polyethyleneisophthalate (50-10)/copolymer (which serves as a heat-sealable adhesive).

Blank metal end portions for containers (e.g. cans), which have been coated with a thin lacquer or enamel coating by the can end manufacturer, are typically punched in order to provide a pour hole. Then the exterior flexible film and the interior sheet material of this invention are affixed circumjacent the preformed opening in the end portion using both heat and moderate pressure. Generally speaking, the pressure used to affix the interior sheet material to the can end is relatively uniform around the periphery of the pour hole. In the pour hole itself, where the exterior flexible film is firmly bonded to the interior sheet material, the pressure is also relatively uniform. The pressures used are generally in the range of about 20 to 60 p.s.i. (1.4 to 4.2 kg/cm$^2$), and the platen temperatures used are generally in the range of about 300° to 450° F. (150° to 232° C.). The time required at such pressures and temperatures, to effect good bonds between the interior sheet material to the can end and between the interior sheet material and exterior flexible film is normally not more than a few seconds (e.g. 2–5 seconds). The entire bonding operation may be done, if desired, at one time using a heated press or the like.

I claim:

1. An end portion for a container, said end portion having at least one preformed opening and an easy open closure system for said opening, said easy open closure system comprising:

a. an interior sheet material which covers the underside of said opening and which is firmly adhered to the bottom of said end portion circumjacent said opening, said interior sheet comprising i. a backing member of about 15 to 100 micrometers in thickness and having a ppt value in the range of about 15 to 200 grams/ply;

ii. a layer of adhesive having a thickness of about 3 to 100 micrometers, firmly adhering said backing member to said end portion;

b. an exterior flexible film circumjacent said opening, said flexible film at least 6.3 mm in width and about 25–250 micrometers in thickness which neither breaks nor elongates more than 25% under a tension of 4 pounds (1.8 kg) and which is capable of being pulled back upon itself without rupturing, wherein said flexible film is essentially free of adhesive and is bonded to said interior sheet material in the area of said opening by means of said layer of adhesive of said interior sheet material;

wherein said means of adhesive attachment will withstand a force of up to 22 pounds per inch width (3.9 kg per cm width) of said exterior flexible film at temperatures from at least 35° F. to 100° F. (2° to 38° C.) without separation of said flexible film from said interior sheet material and wherein at least one of said flexible film and said interior sheet material is moisture impervious.

2. An end portion for a container in accordance with claim 1, wherein said exterior flexible film is conformable.

3. An end portion for a container in accordance with claim 1, wherein the portion of said exterior flexible film in the area of said preformed opening has been coated with a primer.

4. An end portion for a container in accordance with claim 3, wherein said primer is a polycarbodiimide.

5. An end portion for a container in accordance with claim 1, wherein said exterior flexible film is selected from the group consisting of polytetramethylene terephthalate, polyamide derived from 6-6 nylon, physical blends of polytetramethylene terephthalate/polyethylene, physical blends of polytetramethylene terephthalate/phenoxy, polyvinylchloride, glycol modified polyethyleneterephthalate, polypropylene, composites of polyethyleneterephthalate/polyethylene, graft copolymers comprising acrylonitrile/methylmethacrylate copolymer grafted onto acrylonitrile/butadiene copolymer backbone, aluminum foil and aluminum foil composites.

6. An end portion for a container in accordance with claim 1, wherein said exterior flexible film is opaque.

7. An end portion for a container in accordance with claim 1, wherein the backing member of said interior sheet material is selected from the group consisting of polyethyleneterephthalate, polyvinylchloride, composite films of polyethyleneterephthalate and polyethyleneterephthalate/polyethyleneisophthalate copolymer, and graft copolymers comprising acrylonitrile/methylmethacrylate copolymer grafted onto an acrylonitrile/butadiene copolymer backbone.

8. An end portion for a container in accordance with claim 1, wherein said adhesive on said interior sheet material is a thermoplastic copolyester elastomer.

9. An end portion for a container in accordance with claim 1, said end portion further having a centrally disposed vent opening.

10. An end portion for a container in accordance with claim 1, in which there is associated with said exterior flexible film means for preventing total separation of said exterior flexible film from said end portion.

11. An end portion for a container in accordance with claim 10, wherein said means for preventing total separation of said exterior flexible film from said end portion is a tongue-like protrusion anchored to said end portion and projecting into said preformed opening.

12. An end portion for a container in accordance with claim 10 wherein said means for preventing total separation of said exterior flexible film from said end portion is a narrow band of adhesive on said exterior flexible film.

13. An end portion for a container in accordance with claim 1, wherein said closure system is adapted to withstand internal pressures in the range of about 0.25 to 6 atmospheres at temperatures less than 37° C.

14. An end portion for a container in accordance with claim 1, wherein said closure system is adapted to withstand internal pressures in the range of about 0.25 to 2 atmospheres at temperatures less than 37° C.

* * * * *

UNITED STATES PATENT AND TRADEMARK OFFICE

CERTIFICATE OF CORRECTION

PATENT NO. : 4,215,791

DATED : August 5, 1980

INVENTOR(S) : Wilfred R. Brochman

It is certified that error appears in the above—identified patent and that said Letters Patent is hereby corrected as shown below:

Column 7, lines 32-33, "terephthalate" should be deleted.

Signed and Sealed this

*Thirtieth* Day of *December 1980*

[SEAL]

*Attest:*

SIDNEY A. DIAMOND

*Attesting Officer*

*Commissioner of Patents and Trademarks*

Disclaimer and Dedication 4,215,791.—*Wilfred R. Brochman,* Oakland, Minn. EASY OPEN CLOSURE SYSTEM. Patent dated Aug. 5, 1980. Disclaimer and dedication filed Mar. 23, 1984, by the assignee, *Minnesota Mining and Manufacturing Co.*

Hereby disclaims and dedicates to the Public the remaining term of said patent.

[*Official Gazette May 22, 1984.*]